US005776646A

United States Patent [19]

Hagi et al.

[11] Patent Number: 5,776,646

[45] Date of Patent: Jul. 7, 1998

[54] NEGATIVELY CHARGEABLE TONER WITH SPECIFIED FINE PARTICLES ADDED EXTERNALLY

[75] Inventors: Masayuki Hagi, Takatsuki; Takeshi Arai, Akashi; Junichi Tamaoki, Sakai; Hiroyuki Fukuda, Kobe, all of Japan

[73] Assignee: Minolta Co., Ltd., Osaka, Japan

[21] Appl. No.: 879,330

[22] Filed: Jun. 20, 1997

[30] Foreign Application Priority Data

Jun. 21, 1996 [JP] Japan ..... 8-161629
Jun. 21, 1996 [JP] Japan ..... 8-161630

[51] Int. Cl.[6] ..... G03G 9/097; G03G 9/107

[52] U.S. Cl. ..... 430/106.6; 430/110; 430/111

[58] Field of Search ..... 430/106.6, 110, 430/111

[56] References Cited

U.S. PATENT DOCUMENTS

| | | | |
|---|---|---|---|
| 4,623,605 | 11/1986 | Kato et al. | 430/110 |
| 4,652,509 | 3/1987 | Shirose et al. | 430/110 |
| 4,904,558 | 2/1990 | Nagatsuka et al. | 430/122 |
| 5,155,000 | 10/1992 | Matsumura et al. | 430/110 |
| 5,272,040 | 12/1993 | Nakasawa et al. | 430/110 |
| 5,508,139 | 4/1996 | Tanaka et al. | 430/111 |
| 5,627,000 | 5/1997 | Yamazaki et al. | 430/99 |
| 5,707,772 | 1/1998 | Akimoto et al. | 430/110 |

*Primary Examiner*—Roland Martin

[57] ABSTRACT

The invention relates to:

(1) negatively chargeable toner particles with inorganic fine particles externally added thereto, the inorganic fine particles having a specified number-mean particle size and a specified chargeability, and (2) toner particles with silica fine particles and titania fine particles added to the toner particles in specified quantities and respectively having a specified number-mean particle size and a specified degree of hydrophobicity and, in combination therewith, inorganic particles having a specified number-mean particle size added to the toner particles.

The toner of the present invention has good environmental stability, non-sticking characteristic, and good storage stability, and is capable of forming good images without aggregation noise and free of fogging after repetition of copy. The toner is suitable for full-color image formation in particular.

20 Claims, No Drawings

NEGATIVELY CHARGEABLE TONER WITH SPECIFIED FINE PARTICLES ADDED EXTERNALLY

BACKGROUND OF THE INVENTION

1. Field of the Invention

The present invention relates to a negatively chargeable toner and negatively chargeable developing agent for developing an electrostatic latent image formed on an electrostatic latent image-supporting member and, more particularly, to an electrostatic latent image developing toner for use in a full-color copying machine or a full-color image forming apparatus, such as a full-color laser beam printer.

2. Description of the Prior Art

In the art of image reproduction, such as copying machine, printer, and facsimile, there has been widely employed an image forming method such that an electrostatic latent image formed on an electrostatic latent image-supporting member, such as a photoconductor, is developed with a toner, the developed toner image being transferred onto a recording member such as recording paper. Such a method has also been employed in various types of full-color image forming apparatuses for reproducing a multi-color image by placing plural color toners one over another. For use in such image forming apparatuses, and more specifically in image forming apparatus of the normal development system which employs a positively chargeable, high-durability amorphous silicon photoconductor as an electrostatic latent image-supporting member, and also in image forming apparatus of the reversal development system which employs a negatively chargeable, high-performance, low-cost organic photoconductor as an electrostatic latent image-supporting member, there exists a need for a negatively chargeable toner having good performance characteristics. An image forming apparatus of the reversal development system in particular is employed in a digital system image forming apparatus of the type which forms an electrostatic image in dot units, and a toner having good negative chargeability is needed for use in such a digital system apparatus.

Varying characteristic features are required of negatively chargeable toners for use in such different types of image forming apparatuses. One of the requirements is high fluidity. For example, in a variable contrast image reproduction system, such as a variable area gradation system or a laser intensity modulation system, as employed in digital image forming apparatuses, high fluidity is required of the toner in order that image reproduction with satisfactory gradation may be achieved. More particularly, in the laser intensity modulation system, in which tone reproduction is carried out according to a change in toner deposit corresponding to a change in the charge of latent image due to a laser intesity modulation, higher fluidity is required of the toner.

A full-color toner is required to have light transmission properties. Therefore, the binder resin used in full-color toner particles must have sharp melt properties. However, toner particles having such properties are liable to aggregation due to a stress inside the development apparatus so that white spots due to such aggregation may easily occur in solid print images.

Further, such toner is required to have various other characteristics including a narrower range of toner charge variations relative to changes in ambient conditions, such as ambient temperature and humidity, no possibility of toner component adhesion to the photoconductor (that is a cause of black spots, hereinafter sometimes referred to as BS), and no formation of fogs on paper due to developer deterioration even after many sheets of copying.

In order to satisfy the foregoing characteristic requirements, however, various technical problems must be solved. To improve the toner fluidity, for example, an effective means is to externally add a fluidizing agent, such as fine silica particles or fine titania particles, to the toner, in an increased quantity of addition of such agent. However, when the quantity of addition of silica fine particles is increased for fluidity improvement, for example, the environmental stability of the toner will be lowered. An increase in the quantity of an externally added component will result in an increase in the quantity of the component which passes through the cleaning blade and adheres to the surface of the photoconductor and, as a consequence, such externally added component will act as a nucleus to which other toner component may adhere in a trailing fashion during a cleaning operation. Thus, the problem of toner component adhesion to the photoconductor (i.e., problem of BS) will become more pronounced. If the quantity of such externally added component is decreased, not only will fluidity insufficiency be caused, but also toner aggregation will occur due to stress and the like within the developing apparatus during repetition of copying, with the result that there will arise the problem of voids in solid print images. With a high-fluidity toner having a relatively large amount of silica fine particles or the like added thereto, the trouble is that silica fine particles or the like are liable to adhere to the carrier (called "spent") in the course of repetition of copying, resulting in reduced chargeability of the carrier relative to the toner so that the problem of fog-formation on paper will arise more noticeably.

SUMMARY OF THE INVENTION

It is a primary object of the present invention to provide a negatively chargeable toner and a negatively chargeable developing agent which are free from the foregoing problems.

More specifically, it is an object of the invention to provide a negatively chargeable toner and a negatively chargeable developing agent which have good environmental stability and involve only a small range of variations in toner charge due to humidity and/or temperature changes, and which involve no trouble of voids or the like in copied images.

It is another object of the invention to provide a negatively chargeable toner and a negatively chargeable developing agent which have good fluidity and involve no trouble of toner component adhesion to the photoconductor.

It is another object of the invention to provide a negatively chargeable toner and a negatively chargeable developing agent which involve no problem of formation of fogs on paper due to repetition of copy.

It is a further object of the invention to provide a negatively chargeable toner and a negatively chargeable developing agent which are suitable for full-color image formation.

The present image provides a negatively chargeable toner comprising:

toner particles;

first inorganic fine particles having:

a number-mean particle size of from 10 to 30 nm; and a blow-off charge of from −2000 to −500 μC;

second inorganic fine particles having:

a number-mean particle size of from 10 to 90 nm; and a blow-off charge of from −300 to +50 μC; and third inorganic fine particles having:

a number-mean particle size of from 100 to 1000 nm; and a blow-off charge of from −10 to +100 μC.

The present invention also provides a toner comprising:

toner particles;

hydrophobic silica fine particles having:

a number-mean particle size of from 10 to 50 nm, and a hydrophobicity of 50 or more;

hydrophobic titania fine particles having:

a number-mean particle size of from 10 to 50 nm, and a hydrophobicity of 50 or more;

the combined proportion of the hydrophobic silica fine particles and hydrophobic titania fine particles being from 1 to 3% by weight relative to the toner particles; and inorganic fine particles having:

a number-mean particle size of from 100 to 3000 nm; the proportion of the inorganic fine particles relative to the toner particles being from 0.3 to 3% by weight.

DETAILED DESCRIPTION OF THE INVENTION

The foregoing objects of the present invention can be accomplished by:

(1) negatively chargeable toner particles with inorganic fine particles externally added thereto, the inorganic fine particles having a specified number-mean particle size and a specified chargeability (hereinafter referred to as the "first invention"), or (2) toner particles (colored resin particles) with silica fine particles and titania fine particles added to the toner particles in specified quantities and respectively having a specified number-mean particle size and a specified degree of hydrophobicity and, in combination therewith, inorganic particles having a specified number-mean particle size further added to the toner particles (hereinafter referred to as the "second invention").

First, description is given of the first invention.

The first invention pertains to a negatively chargeable toner including negatively chargeable toner particles and at least three kinds of external additives added in mixture therewith, wherein the external additives comprise first inorganic fine particles having a number-mean particle size of from 10 to 30 nm, second inorganic fine particles having a number-mean particle size of from 10 to 90 nm, and third inorganic fine particles having a number-mean particle size of from 100 to 1000 nm, the first inorganic fine particles having a blow-off charge of −2000 to −500 μC/g, the second inorganic fine particles having a blow-off charge of −300 to +50 μC/g, the third inorganic fine particles having a blow-off charge of −10 to +100 μC/g, and a negatively chargeable developing agent comprising the toner and magnetic carrier particles.

The first invention eliminates the trouble of aggregation noise, is environmentally stable, and solves the problem of toner component adhesion. In addition, the first invention effectively prevents fogging after many times of copy.

The toner of the first invention is applicable to various color toners, including magenta toner, cyan toner, yellow toner, and black toner, which are used in full-color image forming apparatus for multi-color image reproduction.

In the first invention, for the first inorganic fine particles are used inorganic fine particles having a primary particle number-mean particle size of from 10 to 30 nm, preferably from 10 to 25 nm, and a blow-off charge of from −2000 to −500 μC/g, preferably from −1500 to −800 μC/g, with respect to iron powder. The addition of such first inorganic fine particles can enhance the fluidity and negative chargeability of the toner and provide the cleaning blade with good lubricity relative to the photoconductor. If the mean particle size is more than 30 nm, no sufficient improvement can be obtained with respect to the fluidity of the toner and the lubricity of the cleaning blade. If the mean particle size is less than 10 nm, the first inorganic fine particles may be liable to be buried in toner particles, so that large variations may occur in powder characteristics of the toner during repetition of copy and/or the environmental stability of the toner may be lowered.

For the first inorganic fine particles, fine particles of such materials as silica, titania, alumina, barium titanate, magnesium titanate, calcium titanate, strontium titanate, chrome oxide, cerium oxide, magnesium oxide, and zirconium oxide may be used alone or in combination of two or more kinds. Silica fine particles are preferred from the view points of fluidity improvement and negative charging of toner particles.

The quantity of addition of the first inorganic fine particles to the toner particles is from 0.1 to 3.0% by weight, preferably from 0.3 to 2.0% by weight. If the quantity of addition is less than 0.1% by weight, the effect of the addition is insufficient. If the quantity of addition is more than 3% by weight, the trouble of BS may occur, and/or fogging is likely to occur during repetition of copy.

For the second inorganic fine particles are used inorganic fine particles having a primary particle number-mean particle size of from 10 to 90 nm, preferably from 30 to 80 nm, and a blow-off charge of from −300 to +50 μC/g, preferably from −300 to −10 μC/g, more preferably from −200 to −30 μC/g, with respect to iron powder. The use of such second inorganic fine particles eliminates the problem of image density lowering due to charging-up by the first inorganic fine particles in a low temperature and low humidity environment, prevents the occurrence of voids in copied images, and improves the thermal storage stability of the toner. If the mean particle size is more than 90 nm, the coverage of the particles relative to the toner is reduced, so that the effects of the particles for enhancing environmental stability and thermal storage stability of the toner, as well as for preventing voids in copied images, are lowered. If the mean particle size is less than 10 nm, the agitation stress within the developing apparatus during repetition copy may cause the fine particles to be readily buried in the toner particles and, as a result, the effect of the fine particles for inhibiting the aggregation of the developing agent is lowered so that voids are likely to occur in solid copied images.

The second inorganic fine particles may comprise, in combination, particles having a number-mean particle size of from 10 to 30 nm and particles having a number-mean particle size of from 30 to 90 nm, preferably from 35 to 80 nm.

For the second inorganic fine particles, fine particles of such materials as silica, titania, alumina, barium titanate, magnesium titanate, calcium titanate, strontium titanate, chrome oxide, cerium oxide, magnesium oxide, and zirconium oxide may be used alone or in combination of two or more kinds. Silica fine particles are preferred from the view point of environmental stability improvement. For the titania fine particles, anatase-type titania, rutile-type titania, amorphous titania, and the like may be used, but anatase-type titania is preferred.

The quantity of addition of the second inorganic fine particles to the toner particles is from 0.1 to 3.0% by weight, preferably from 0.3 to 2.0% by weight. If the quantity of addition is less than 0.1% by weight, the effect of the addition is insufficient. If the quantity of addition is more than 3% by weight, the trouble of BS may easily occur.

From the view points of fluidity improvement and voids prevention, it is desirable that the first and second inorganic fine particles be used in a combined total quantity range of from 1.0 to 3.0% by weight.

Preferably, the first and second inorganic fine particles are surface treated by a hydrophobicizing agent. In particular, such inorganic fine particles having a hydrophobicity of 50 or more are preferably used. By using such hydrophobicized inorganic fine particles it is possible to prevent any lowering in the quantity of toner charge under high temperature and high humidity conditions.

For the purpose of the present invention, the degree of hydrophobicity was measured by a methanol wettability method. That is, droplets of methanol were dropped into a water in which a test sample was dispersed, and the weight of methanol required to wet the entire test sample was measured. In this measurement, the weight of methanol in the water plus methanol was expressed percentage, and the percentage obtained was taken as the degree of hydrophobicity.

Hydrophobicizing agents useful for surface treatment of the inorganic fine particles include silane coupling agents, titanate coupling agents, silicone oils, and silicone varnishes. Examples of useful silane coupling agents are hexamethyl disilazane, trimethylsilane, chlorotrimethyl silane, dichlorodimethyl silane, trichloromethyl silane, allyldichloromethyl silane, benzyldichloromethyl silane, methyl trimethoxysilane, methyl triethoxysilane, isobutyl trimethoxysilane, dimethyl dimethoxysilane, dimethyl diethoxysilane, trimethyl methoxysilane, hydroxypropyl trimethoxysilane, phenyl trimethoxysilane, n-butyl trimethoxysilane, n-hexadecyl trimethoxysilane, n-octadecyl trimethoxysilane, vinyl trimethoxysilane, vinyl triethoxysilane, γ-methacryloxypropyl trimethoxysilane, and vinyl triacetoxysilane. Examples of useful silicone oils are dimethyl polysiloxane, methyl hydrogen polysiloxane, and methyl phenyl polysiloxane.

Surface treatment of the inorganic fine particles with any such hydrophobicizing agent may be carried out, for example, by a dry method in which the hydrophobicizing agent is diluted with a solvent and the dilute liquid is added to and mixed with the inorganic fine particles, the mixture being then heated and dried, then disintegrated, or by a wet method in which the inorganic fine particles are dispersed in an aqueous system to give a slurry form and the hydrophobicizing agent is added to and mixed with the slurry, the mixture being then heated and dried, then disintegrated. In particular, where the inorganic fine particles are of titania, the hydrophobicizing treatment of the inorganic fine particles is preferably carried out in an aqueous system from the view points of treated surface uniformity and aggregation preventive characteristic of titania particles.

In the toner of the present invention are used, in addition to the first and second inorganic fine particles, third inorganic fine particles having a number-mean particle size of from 100 to 1000 nm, preferably from 100 to 800 nm, and a blow-off charge of from −10 to +100 μC/g, preferably from +10 to +100 μC/g, more preferably +10 μC/g to 80 μC/g, relative to iron powder. By using such third inorganic fine particles in combination with the first and second inorganic fine particles is it possible to solve the problem of BS and problem of fogging during repetition of copy which arise from the addition of first and second inorganic fine particles. The reason why the problem of BS can be solved is conceivably that the third inorganic fine particles act to reduce the quantity of first and second inorganic fine particles slipping past the blade during a blade cleaning operation. The reason why the problem of fogging during repetition of copy can be solved is conceivably explained by the fact that the presence of third inorganic fine particles having a specified charging capability as adhered to toner surfaces serves to eliminate the possibility of fogging due to a toner charge drop, because the third inorganic fine particles are capable of negatively charging the toner particles even when the externally added material is spent as it adheres to the carrier. From such viewpoints, it is desirable that the third inorganic fine particles should have a charging capability closer to the positive side than the carrier particles. Further, in the present invention, it is to be noted that the third inorganic fine particles adhere to the surface of the toner particles despite their relatively large particle size. Conceivably, this can be explained by the fact that the first inorganic fine particles have high negative chargeability, whereas the third inorganic fine particles have a chargeability of opposite polarity relative to the first inorganic fine particles when considered on the basis of the chargeability of the toner particles. Therefore, it is desirable that the addition of the third inorganic fine particles for mixing with the toner particles be made only after the first inorganic fine particles are mixed with the toner particles. The second inorganic fine particles may be added together with the first inorganic fine particles or the third inorganic fine particles for mixture. Alternatively, the first inorganic particles may be first added for mixture, followed by the addition of the second inorganic fine particles, and then of the third inorganic fine particles.

If the mean particle size of the third inorganic fine particles is less than 100 nm, the BS preventive effect is insufficient. If the mean particle size is more than 1000 nm, the coverage or adhesion strength of the particles relative to toner particles is lowered so that any sufficient BS preventive effect cannot be obtained. Further, where repetitive image forming operations are carried out, the photoconductor may be damaged during blade cleaning; or where a full-color image forming apparatus is employed, a similar damage may occur during the process of press transfer by means of a transfer drum.

For the third inorganic fine particles, fine particles of such materials as silica, titania, alumina, barium titanate, magnesium titanate, calcium titanate, strontium titanate, chrome oxide, cerium oxide, magnesium oxide, and zirconium oxide may be used alone or in combination of two or more kinds. Since the third inorganic fine particles are of relatively large particle size with a number-mean particle size of from 100 to 1000 nm, they may be particles which exist as primary particles having a mean particle size within the above mentioned range, or particles which exist in the form of aggregates (e.g., sintered aggregates) of primary particles and have a mean particle size within the above mentioned range, or particles which comprise primary particles and primary particle aggregates present in mixture and have a mean particle size within the above mentioned range. In particular, fine particles which include sintered aggregates of primary particles and have aforementioned charging characteristic are preferred from the foregoing view points. Preferred as such fine particles are strontium titanate fine particles. Fine particles of other materials which have been surface treated, for example, with amino silane coupling agent, amino silicone oil or the like for charging property adjustment can also be advantageously used.

The third inorganic fine particles are added to the colored resin particles in a quantity range of from 0.3 to 5.0% by weight, preferably from 0.5 to 3.0% by weight. If the quantity of addition is less than 0.3% by weight, no sufficient effect can be obtained for preventing such troubles as BS, toner dusting and fogging. If the quantity of addition is more than 5% by weight, the photoconductor may be more liable to be damaged and the toner may be unfavorably affected with respect to its charging characteristics.

Next, the second invention will be described.

The second invention pertains to an electrostatic latent image developing toner including colored resin particles containing at least a colorant and a binder resin and, added to and mixed with the colored resin particles, hydrophobic silica fine particles having a number-mean particle size of from 10 to 50 nm and a hydrophobicity of 50 or more, hydrophobic titania fine particles having a number-mean particle size of from 10 to 90 nm and a hydrophobicity of 50 or more, and inorganic fine particles having a number-mean particle size of from 100 to 3000 nm, the combined quantity of addition of the silica fine particles and titania fine particles being from 1 to 3% by weight relative to the colored resin particles, the quantity of addition of the inorganic fine particles being from 0.3 to 3% by weight relative to the colored resin particles.

The second invention eliminates the trouble of aggregation noise, is environmentally stable, and solves the problem of toner component adhesion. In addition, the second invention effectively enhances thermal storage stability.

The toner of the second invention is applicable to various color toners, including magenta toner, cyan toner, yellow toner, and black toner, which are used in full-color image forming apparatus for multi-color image reproduction.

In the second invention, hydrophobic silica fine particles are used which have a primary particle number-mean particle size of from 10 to 50 nm, preferably from 10 to 30 nm, more preferably from 10 to 25 nm, and a hydrophobicity of 50 or more, preferably from 55 to 90. The use of such silica fine particles can enhance the fluidity of the toner to thereby improve the tone reproduction capability of the toner, and provide the cleaning blade with good lubricity relative to the photoconductor. If the mean particle size is more than 50 nm, no sufficient improvement can be obtained with respect to the fluidity of the toner and the lubricity of the cleaning blade. If the mean particle size is less than 10 nm, the silica fine particles may be liable to be buried in toner particles, so that large variations may occur in powder characteristics of the toner during repetition of copy and/or the environmental stability of the toner may be lowered. The degree of hydrophobicity is lower than 50, fogging is likely to occur in a white portion of images under a high temperature and high humidity environment.

For the titania fine particle component, hydrophobic titania fine particles are used which have a primary particle number-mean particle size of from 10 to 90 nm, preferably from 30 to 90 nm, more preferably from 35 to 80 nm, and a hydrophobicity of 50 or more, preferably from 55 to 90. By using such titania fine particles it is possible to eliminate the problem of image density lowering due to the presence of the silica fine particles in a high temperature and high humidity environment, prevent the trouble of white spots, and enhance thermal storage stability of the toner. If the mean particle size is more than 90 nm, coverage of the titania particles relative to the toner is reduced, so that the effects of the particles for enhancing environmental stability and thermal storage stability of the toner, as well as for preventing voids in copied images, are lowered. If the mean particle size is less than 10 nm, the agitation stress within the developing apparatus during repetition of copy may cause the titania particles to be readily buried in the toner particles and, as a result, the effect of the titania particles for inhibiting the aggregation of the developing agent is lowered so that voids are likely to occur in solid copied images.

The titania fine particles may comprise, in combination, smaller size particles having a number-mean particle size of from 10 to 30 nm and larger size particles having a number-mean particle size of from 30 to 90 nm, preferably from 35 to 80 nm. The smaller size particles contribute to fluidity improvement, and the larger size particles contribute more effectively toward thermal storage stability improvement and prevention of white spot occurrence in copied images.

For the titania fine particles, anatase-type titania, rutile-type titania, amorphous titania, and the like may be used, but anatase-type titania is preferred.

The combined quantity of addition of the silica fine particles and titania fine particles is from 1 to 3% by weight, preferably from 1.2 to 2.5% by weight. If the quantity of addition is less than 1% by weight, the void preventing effect of the addition is insufficient. If the quantity of addition is more than 3% by weight, the trouble of BS may easily occur. The weight ratio of the silica fine particles to the titania fine particles in their combined quantity of addition may vary depending upon their respective particle sizes, but may be generally 9:1 to 1:9, preferably 7:3 to 3:7.

The silica fine particles and titania fine particles are surface treated with a hydrophobicizing agent. Hydrophobicizing agents useful for such purpose include silane coupling agents, titanate coupling agents, silicone oils, and silicone varnishes. Examples of useful silane coupling agents are hexamethyl disilazane, trimethylsilane, chlorotrimethyl silane, dichlorodimethyl silane, trichloromethyl silane, allyldichloromethyl silane, benzyldichloromethyl silane, methyl trimethoxysilane, methyl triethoxysilane, isobutyl trimethoxysilane, dimethyl dimethoxysilane, dimethyl diethoxysilane, trimethyl methoxysilane, hydroxypropyl trimethoxysilane, phenyl trimethoxysilane, n-butyl trimethoxysilane, n-hexadecyl trimethoxysilane, n-octadecyl trimethoxysilane, vinyl trimethoxysilane, vinyl triethoxysilane, γ-methacryloxypropyl trimethoxysilane, and vinyl triacetoxysilane. Examples of useful silicone oils are dimethyl polysiloxane, methyl hydrogen polysiloxane, and methyl phenyl polysiloxane.

Surface treatment of a silica or titania matrix with any such hydrophobicizing agent may be carried out, for example, by a dry method in which the hydrophobicizing agent is diluted with a solvent and the dilute liquid is added to and mixed with the matrix, the mixture being then heated and dried, then disintegrated, or by a wet method in which the matrix is dispersed in an aqueous system to give a slurry form and the hydrophobicizing agent is added to and mixed with the slurry, the mixture being then heated and dried, then disintegrated. In particular, with respect to titania, hydrophobicizing treatment is preferably carried out in an aqueous system from the view points of uniformity of surface treatment with the hydrophobicizing agent and aggregation preventive characteristic of titania particles.

For the purpose of the present invention, the degree of hydrophobicity was measured by a methanol wettability method. That is, droplets of methanol were dropped into water in which a test sample was dispersed, and the weight of methanol required to wet the entire test sample was measured. In this measurement, the weight of methanol in the water plus methanol was expressed percentage, and the percentage obtained was taken as the degree of hydrophobicity.

In the toner of the present invention are used, in addition to the above said titania and silica, inorganic fine particles having a number-mean particle size of from 100 to 3000 nm, preferably from 100 to 2000 nm, more preferably from 100 to 1000 nm are admixed. Using such inorganic fine particles in combination with the titania and silica is it possible to eliminate the trouble of BS which may otherwise occur when silica and titania fine particles are added in a combined quantity of 1% or more by weight for purposes of preventing voids in copied images and enhancing toner fluidity. Conceivably, the reason for this is that the inorganic fine particles act to reduce the quantity of silica and titania particles passing through the blade during a blade cleaning operation. If the mean particle size of the inorganic fine particles is less than 100 nm, their BS preventive effect is insufficient. If the mean particle size is more than 3000 nm, where repetitive image forming operations are carried out, the photoconductor may be damaged during blade cleaning; or where a full-color image forming apparatus is employed, a similar damage may occur during the process of press transfer by means of a transfer drum.

For the inorganic fine particles, fine particles of such materials as silica, titania, alumina, barium titanate, magnesium titanate, calcium titanate, strontium titanate, chrome oxide, cerium oxide, magnesium oxide, and zirconium oxide may be used alone or in combination of two or more kinds. In particular, fine particles which include sintered aggregates of primary particles are preferred. Preferred as such fine particles are strontium titanate fine particles having a number-mean particle size of from 100 to 1000 nm, preferably from 100 to 800 nm.

The inorganic fine particles are added to the colored resin particles in a quantity range of from 0.3 to 5.0% by weight, preferably from 0.5 to 3.0% by weight. If the quantity of addition is less than 0.3% by weight, no sufficient effect can be obtained for preventing the trouble of BS. If the quantity of addition is more than 5% by weight, the photoconductor may be more liable to be damaged and the toner may be unfavorably affected with respect to its charging characteristics.

For the binder resin to be used in the toner of the present invention, resins known in the art may be used including, for example, styrenic resins, acrylic resins such as alkyl acrylate and alkyl methacrylate, styrene-acryl copolymer resins, polyester resins, epoxy resins, silicon resins, olefinic resins, and amide resins. These resins may be used alone or in combination.

In the present invention, the binder resin for use in full-color toners, such as cyan toner, magenta toner, yellow toner, and black toner, is a polyester resin or epoxy resin having a number-mean molecular weight (Mn) of from 3000 to 6000, preferably from 3500 to 5500, the ratio of weight-mean molecular weight (Mw) to number-mean molecular weight ratio (Mn), i.e., Mw/Mn, being from 2 to 6, preferably, from 2.5 to 5.5, a glass transition point of from 50° to 70° C., preferably from 55° to 65° C., and a softening point of from 90° to 110° C., preferably from 90° to 105° C.

If the number-mean molecular weight of the binder resin is less than 3000, a trouble may occur such that when a full-color solid copied image is bent, an image portion peels off so that the image is rendered defective (which means poor flexural fixability). If the number-mean molecular weight is more than 6000, the hot meltability of the toner during a fixing operation is reduced, resulting in a low fixing strength. If Mw/Mn is less than 2, a high-temperature offset is likely to occur. If Mw/Mn is more than 6, the sharp melt characteristic of the toner during a fixing operation is lowered so that transmissibility of the toner to light, as well as color mixability of the toner in the case of full color image formation, is reduced. If the glass transition point is less than 50° C., the toner has only insufficient heat resistance with the result that the toner is liable to aggregate while in storage. If the glass transition point is more than 75° C., the fixability of the toner is lowered, and color mixability of the toner at the time of full color image formation is also lowered. If the softening point is less than 90° C., high-temperature offsetting is likely to occur, whereas if it is more than 110° C., the performance characteristics of the toner are lowered in fixing strength, light transmission, color mixability, and full-color image gloss.

Useful polyester resins are those containing an etherified diphenol as an alcohol component, and an aromatic dicarboxylic acid as a acid component.

Examples of etherified diphenols include polyoxypropylene (2, 2)-2, 2-bis (4-hydroxyphenyl) propane, and polyoxyethylene (2)-2, 2-bis (4-hydroxyphenyl) propane.

It is possible to use, together with such etherified diphenol, for example, diols, such as ethylene glycol, diethylene glycol, triethylene glycol, 1, 2-propylene glycol, 1, 3-propylene glycol, 1, 4-butanediol, and neopentyl glycol; sorbitol, 1, 2, 3, 6-hexanetetraol, 1, 4-sorbitan, pentaerythritol, dipentaerythritol, tripentaerythritol, 1, 2, 4-butanetriol, 1, 2, 5-pentanetriol, glycerol, 2-methylpropanetriol, 2-methyl-1, 2, 4-butanetriol, trimethylolethane, trimethylolpropane, and 1, 3, 5-trihydroxymethylbenzene.

Useful aromatic dicarboxylic acids include aromatic dicarboxylic acids, such as terephthalic acid and isophthalic acid; and anhydrides of, or lower alkylesters of such acids.

Aliphatic dicarboxylic acids may also be used, including, for example, fumaric acid, maleic acid, succinic acid, alkyl or alkenyl succinic acid having 4 to 18 carbon atoms; and anhydrides of, or lower alkylesters of such acids.

Also, for purposes of adjusting the acid value of the polyester resin and enhancing the resin strength, it is possible to use polyvalent carboxylic acids, such as 1, 2, 4-benzenetricarboxylic acid (trimellitic acid), 1, 2, 5-benzenetricarboxylic acid, 2, 5, 7-naphthalenetricarboxylic acid), 1, 2, 4-naphthalene tricarboxylic acid, 1, 2, 5-hexanetricarboxylic acid, 1, 3-dicarboxyl-2-methyl-2-methylene carboxypropane, 1, 2, 4-cyclohexanetricarboxylic acid, tetra(methylenecarboxyl) methane, 1, 2, 7, 8-octane tetracarboxylic acid, pyromellitic acid, and anhydrides of, or lower alkylesters of such acids, in a small quantity range which is not detrimental to the light transmission characteristic of the toner. Where such acid is used with respect to a black toner, no particular consideration is required for its effect on the light transmission characteristic.

For the colorants to be used in the toner of the invention, those known in the art may be used without any particular limitation.

For use in color toners, the colorants are desirably such that they have been subjected to a master batch treatment or flushing treatment for dispersibility improvement. The colorant content of the toner is preferably from 2 to 15 parts by weight relative to 100 parts by weight of the binder resin.

The toner of the invention may include, in addition to the colorant, a charge control agent, magnetic powder, wax and the like as desired.

For the charge control agent, those known as such in the art may be used without being limited to any particular ones.

Charge control agents for use in color toners are colorless, white or light color charge control agents which are not detrimental to the color toner in respect of its tone and light transmission characteristic. For example, charge control agents, such as salicylic metal complex, e.g., a zinc complex of salicylic acid derivatives, calix arene compounds, organic boron compounds, and fluorine-containing quaternary ammonium salt compounds, are preferably used. For the salicylic metal complex, those described in, for example, Japanese Patent Application Laid-Open Sho 53-127726 and 62-145255 may be used. For the calix arene compound, those described in, for example, Japanese Patent Application Laid-Open Hei 2-201378 may be used. For the organic boron compound, those described in, for example, Japanese Patent Application Laid-Open Hei 2-221967 may be used. For the fluorine-containing quaternary ammonium salt compound, those described in, for example, Japanese Patent Application Laid-Open Hei 3-1162 may be used.

Where such charge control agent is used as an additive, the agent is used in a quantity range of from 0.1 to 10 parts by weight, preferably from 0.5 to 5.0 parts by weight, relative to 100 parts by weight of the binder resin.

From the standpoint of high precision image reproduction, it is desirable that the toner of the invention should have its volume-mean particle size adjusted to a range of from 5 to 10 μm, preferably from 6 to 9 μm.

The toner of the invention may be used as a two-component developing toner in which the toner is used in mixture with a carrier, or as a one-component developing toner in which no carrier is used.

Where a carrier is used in combination with the toner of the invention, those known as two-component developing carriers in the art may be used including, for example, a carrier comprised of magnetic particles of iron, ferrite or the like, a resin coat carrier comprising such magnetic particles coated with resin, or a binder type carrier comprising a magnetic powdery mass dispersed in a binder resin. Considering the problem of toner spent or the like, it is preferable to use a resin coat carrier of the type using, as the coating resin, a silicone resin, a copolymer resin (graft copolymer resin) of organopolysiloxane and a vinyl monomer, or a polyester resin, or a binder type carrier using a polyester resin as the binder resin. In particular, a carrier of the type which is coated with a resin produced by reacting isocyanate with a copolymer resin of organopolysiloxane and a vinyl monomer is preferred for use from the view points of chargeability relative to a negatively chargeable toner, durability, environmental stability, and anti-spent behavior. For the vinyl monomer, it is required that the monomer should have a substituent group, such as hydroxyl group, which is reactive with isocyanate. From the view points of high quality copy image and carrier fog-prevention, the carrier is preferably such that it has a volume-mean particle size of from 20 to 100 μm, preferably from 30 to 80 μm.

EXAMPLES

The following examples are given to further illustrate the invention. It is to be understood, however, that the invention is not intended to be limited to the specific examples.

PRODUCTION OF POLYESTER RESIN

Into a 2-liter, 4-necked flask, fitted with a reflux condenser, a water separator, a nitrogen gas induction pipe, a thermometer, and a stirrer, and placed in a mantle heater, were charged polyoxypropylene (2, 2)-2, 2-bis(4-hydroxyphenyl) propane (PO), polyoxyethylene (2, 0)-2, 2-bis(4-hydroxyphenyl) propane (EO), fumaric acid (FA) and terephthalic acid (TPA) in a molar ratio of 5:5:5:4. The materials were heated and stirred into reaction while nitrogen was introduced into the flask. The progress of reaction was followed while acid value measurement was made, and the reaction was ended when a predetermined acid value was reached. Thus, a polyester resin was obtained which had a number-mean molecular weight Mn of 4800, a weight-mean molecular weight Mw to number-mean molecular weight Mn ratio Mw/Mn of 4.0, a glass transition point of 58° C., and a softening point of 100° C.

Measurement of number-mean molecular weight and weight-mean molecular weight was made by using gel permeation chromatography (instrument used: type 807-IT, manufactured by Nihon Bunko Kogyo K.K.), with tetrahydrofuran, as a carrier solvent, made to flow at a rate of 1 kg/cm$^3$ through the column kept at 40° C. Sample 30 mg, for measurement was dissolved in 20 ml of tetrahydrofuran, and the resulting solution was introduced into the column along with the carrier solvent. The number-mean molecular weight and weight-mean molecular weight were determined in terms of polystyrene.

Measurement of glass transition point was made with 10 mg of sample by using a differential scanning calorimeter (DSC-200, manufactured by Seiko Denshi K.K.), at a heating rate of 10° C./min, with alumina used as a reference. A shoulder value in a main absorption peak is taken as the glass transition point.

Measurement of softening point was made with 1.0 g of sample by using a flow tester (CFT-500, manufactured by Shimazu Seisakusyo K.K.) equipped with a die of 1.00 mm pore diameter×1.00 mm pore length under the conditions of: temperature rise rate, 3.0° C./min; preheating time, 180 sec; load, 30 kg; and measuring temperature range, 60° to 140° C. The temperature at which ½ of the sample flowed out was taken as the softening point.

EXAMPLES WITH RESPECT TO FIRST INVENTION

Preparation of Toner Particles A

The above described polyester resin and a magenta pigment (C. I. pigment red 184) were charged into a press kneader to give a resin:pigment weight ratio of 7:3 and were kneaded together. After cooling, the kneaded mixture was pulverized by a feather mill to obtain a pigment master batch.

Ninety three parts by weight of the polyester resin, 10 parts by weight of the pigment master batch, and 2 parts by weight of a charge control agent (zinc salicylate complex: E-84, made by Orient Kagaku Kogyo) were mixed by a Henschel mixer. The mixture was then kneaded by a twin-screw extruding-kneader. After having been cooled, the kneaded mixture was subjected to coarse milling by a feather mill, then to pulverization by a jet mill. The resulting particles were classified and, as a result, toner particles A having a volume-mean particle size of 8.5 μm were obtained. The quantity of blow off charge of the toner particles relative to iron powder was −53 μC/g. In place of the iron powder, a carrier obtained in the example of carrier preparation to be described hereinafter was used in measuring the quantity of blow-off charge. The measurement showed a blow-off charge quantity of −20 μC/g.

The measurement of blow-off charge quantity was made in the following way according to the blow-off method.

Twenty five grams of reference iron carrier (Z150/250, produced by Powdertech) and 50 mg of sample, placed in a 250 cc polybottle, were mixed together by a turbler mixer for 1 minute. Then, 0.1 g of sample was placed in a measuring container having a 400 mesh stainless steel screen, and measurement was made by a blow-off charge measuring device (TB-200, manufactured by Toshiba Chemical K.K.) and under the conditions of: nitrogen gas flow rate, 1.0 kgf/cm$^2$, and inflow time, 60 sec.

Preparation of Toner Particles B

One hundred parts by weight of the polyester resin, 3 parts by weight of carbon black (Morgal L, produced by Cabot K.K.), and 2 parts by weight of a charge control agent (zinc salicylate complex: E-84, made by Orient Kagaku Kogyo K.K.) were mixed by a Henschel mixer. The mixture was then kneaded by a twin-screw extruding-kneader. After being cooled, the kneaded mixture was subjected to coarse milling by a feather mill, then to pulverization by a jet mill. The resulting particles were classified and, as a result, toner particles B having a volume-mean particle size of 8.5 μm were obtained. The quantity of blow off charge of the toner particles relative to iron powder was −48 μC/g. In place of the iron powder, a carrier obtained in the example of carrier preparation to be described hereinafter was used in measuring the quantity of blow-off charge. A blow-off charge quantity was −18 μC/g.

Preparation of Toner

Toner particles obtained as above described were mixed with external additives shown in Table 1, in quantities shown in Table 2 in a Henschel mixer. Mixed particles were sifted through a 200-mesh circular vibrating screen. In this way, toners of several Examples and toners of several Comparative Examples were obtained. In each example, mixing was carried out in such a way that after first inorganic fine particles were mixed with toner particles in the Henschel mixer, second and third inorganic fine particles were introduced into the mixer for being mixed with the toner particles. In comparative examples in which first inorganic fine particles were not added, all the inorganic fine particles were collectively added to toner particles for mixture therewith. In Table 1, respective charge quantity shown represents a blow-off charge quantity measured with respect to corresponding inorganic fine particles according to the above described method.

TABLE 1

| | Type of Inorganic Fine Particles | Charge Quantity (μC/g) |
|---|---|---|
| A 1 | #130, number-mean particle size 15 nm (made by Nippon Aerosil), surface-treated with hexamethyl disilazane; hydrophobicity 60 | −1138 |
| B 1 | Anatase-type titania, number-mean particle size 50 nm, surface-treated with n-butyl trimethoxy silane; hydrophobicity 55 | −129 |
| B 2 | Anatase-type titania, number-mean particle size 15 nm, surface-treated with n-butyl trimethoxy silane; hydrophobicity 60 | −71 |
| C 1 | Strontium titanate, number-mean particle size 350 nm | +16 |
| C 2 | Rutile-type titania, number-mean particle size 250 nm, surface-treated with γ-(2-aminoethyl) aminopropyl trimethoxysilane | +21 |
| C 3 | Rutile-type titania, number-mean particle size 250 nm | −38 |
| C 4 | Rutile-type titania, number-mean particle size 2000 nm | −15 |
| C 5 | Alumina-treated titania, number-mean particle size 200 nm, obtained through the process of treating anatase-type titania, number-mean particle size 50 nm, with aqueous dispersion of aluminum chloride, then drying the same, followed by calcination and grinding; surface-treated with γ-(2-aminoethyl) aminopropyl trimethoxysilane | +13 |

TABLE 2

| | | 1st inorganic fine particle | | 2nd inorganic fine Particle | | 3rd inorganic fine particle | |
|---|---|---|---|---|---|---|---|
| | Toner particle | Type | Quantity (wt %) | Type | Quantity (wt %) | Type | Quantity (wt %) |
| Example | | | | | | | |
| I-1 | A | A1 | 0.6 | B1 | 0.6 | C1 | 1.5 |
| I-2 | A | A1 | 0.6 | B1 | 0.6 | C1 | 0.8 |
| I-3 | A | A1 | 0.6 | B1 | 0.6 | C1 | 1.8 |
| I-4 | A | A1 | 0.75 | B1 | 0.75 | C1 | 1.5 |
| I-5 | A | A1 | 0.6 | B1 | 0.6 | C2 | 0.8 |
| I-6 | A | A1 | 0.6 | B1 | 0.6 | C2 | 1.5 |
| I-7 | A | A1 | 0.6 | B1 | 0.6 | C5 | 0.8 |
| I-8 | B | A1 | 0.6 | B1 | 0.3 | C1 | 1.5 |
| | | | | B2 | 0.3 | | |
| Comparative Example | | | | | | | |
| I-1 | A | A1 | 0.6 | B1 | 0.6 | C4 | 1.5 |
| I-2 | A | A1 | 0.6 | B1 | 0.6 | C3 | 0.8 |
| I-3 | A | A1 | 0.6 | B1 | 0.6 | C3 | 1.5 |

TABLE 2-continued

| | | 1st inorganic fine particle | | 2nd inorganic fine Particle | | 3rd inorganic fine particle | |
|---|---|---|---|---|---|---|---|
| | Toner particle | Type | Quantity (wt %) | Type | Quantity (wt %) | Type | Quantity (wt %) |
| I-4 | A | A1 | 0.4 | B1 | 0.4 | | Not added |
| I-5 | A | A1 | 0.75 | B1 | 0.75 | | Not added |
| I-6 | A | | Not added | B1<br>B2 | 0.6<br>0.6 | C1 | 1.5 |
| I-7 | A | A1 | 1.0 | | Not added | C1 | 1.5 |
| I-8 | A | | Not added | B1 | 1.0 | C1 | 1.5 |

EXAMPLE OF CARRIER PREPARATION

One hundred parts by weight of methyl ethyl ketone were charged into a 500 ml-flask equipped with a stirrer, a thermometer, a nitrogen induction pipe, and a dropping device. Separately, a solution obtained at 80° C. under nitrogen atmosphere by dissolving 36.7 parts by weight of methyl methacrylate, 5.1 parts by weight of 2-hydroxyethyl methacrylate, 58.2 parts by weight of 3-methacryloxypropyl tris(trimethylsiloxy) silane, and 1 part by weight of 1, 1'-azobis(cyclohexane-1-carbonitrile in 100 parts by weight of methyl ethyl ketone was trickled down into a reaction vessel over 2 hours and was allowed to be aged for 5 hours.

To the resultant resin was added, as a cross-linking agent, isophorone diisocyanate/trimethylolpropane adduct (IPD/TMP: NCO %=6.1%) to give an OH/NCO molar ratio of 1/1. The resin solution was diluted with methyl ethyl ketone. Thus, a coat resin solution having a solid content of 3% by weight was obtained.

Calcined ferrite powder—300 (volume-mean particle size: 50 μm; produced by Powdertech K.K.) was used as a core material, and the coat resin solution was coated on the core material by a SPIRA COTA (manufactured by Okada Seiko K.K.) so that the resin coverage relative to the core material was 1.5% by weight, the coating being then dried. The carrier thus obtained was allowed to stand in a hot-air circulation type oven at 160° C. for 1 hour for being calcined. After being cooled, the ferrite powder bulk was disintegrated by a sieve shaking machine fitted with a screen mesh having 106 μm openings and 75 μm openings. Thus, a resin coated carrier was obtained.

Aggregation Noise (Voids in Copied Images)

Each respective toner and the carrier obtained in the above described preparation example were mixed so that the proportion of the toner was 7% by weight, whereby a developing agent was prepared. Five thousands copies of B/W 15% image were made with the developing agent by using a digital full color copying machine CF900 (manufactured by Minolta K.K.) under N/N environmental conditions (25° C., 50%). After the durability test with respect to copy, a full solid image (ID=1.2) was copied on 3 sheets of A3 paper. Evaluation was made on the following criteria and average value of the three sheets was taken as the result of the evaluation. The evaluation criteria are as follows. Where an image irregularity (void) which was as large as 2 $mm^2$ and less than ½ of ID of the solid image was present in the copied solid image, the developing agent was rated x. Where no void was found, but an aggregate nucleus of about 0.3 μm was observed in the image, and where 3 spots or more at which the image density was somewhat lower were found around the nucleus in the image, the developing agent was rated Δ. Where such spots were less than 3 in number, the developing agent was rated ○. Where no such spot was found, the developing agent was rated ⊙.

Environmental Stability

A developing agent was prepared in the same way as above described, and a B/W 15% image was copied with the developing agent by using CF 900 under an L/L environmental conditions (10° C., 15%). The image density of the image obtained was measured by using a Macbeth reflection densitometer RD-900. Where the image density was 1.2 or more, the developing agent was rated ○; where the image density was not less than 1.0 but less than 1.2, the developing agent was rated Δ; and where the image density was less than 1.0, the developing agent was rated x.

Five thousands copies of a B/W 15% image were made by using CF900 under H/H conditions (30°, 85%). White ground portions of the image obtained were visually evaluated. Where no fog was found in the image, the developing agent was rated ○; where some fog was present but there was no problem from practical points of view, the developing agent was rated Δ; and where many fogs were present, involving problems from practical view points, the developing agent was rated x. The results are shown in Table 3.

Toner Component Adhesion to Photoconductor

With each respective developing agent prepared in the same manner as above described, 5000 copies of a B/W 15% image were made by using CF900 under N/N ambient conditions. Evaluations were made on the basis of initial and post-printing visual and electromicroscopic observations of the photoconductor surface, and also on the basis of visual observation of initial solid copied-image as well as solid copied-image after the 5000 times of copy. Where no adhesion of externally added material was found through electromicroscopic observation, the developer was rated ⊙. Where adhesion of externally added material on the photoconductor was found through electromicroscopic observation, but no such adhesion was visually found and there was no image noise occurrence, the developer was rated ○. Where adhesion of externally added material and toner component were visually observed on the photoconductor, but there was no noise occurrence, the toner was rated Δ. Where adhesion of externally added material and toner component were visually observed on the photoconductor and such adhesion was reflected as noise on the image, the toner was rated x. The results are shown in Table 3.

Evaluation of Fogging After Durability Test with Respect to Copy

With respective developing agent prepared in the same way as above described, 10000 copies of a B/W 15% image were made by using CF900 under N/N ambient conditions. After 10000 times of copy, where no fog was found in any white ground portion, the toner was rated ◎. Where some fogging was found but involved no problem from practical points of view, the toner was rated Δ. Where fogging did occur and involved a problem from practical points of view. The results are shown in Table 3.

TABLE 3

| | Aggregation | Environmental stability | | Toner component | Fogging after dur- |
|---|---|---|---|---|---|
| | noise | L/L | H/H | adhesion | ability test |
| Example I-1 | ○ | ○ | ○ | ◎ | ○ |
| Example I-2 | ○ | ○ | ○ | ○ | Δ |
| Example I-3 | ◎ | ○ | ○ | ◎ | ○ |
| Example I-4 | ◎ | ○ | ○ | ○ | ○ |
| Example I-5 | ○ | ○ | ○ | ○ | Δ |
| Example I-6 | ◎ | ○ | ○ | ◎ | ○ |
| Example I-7 | ○ | ○ | ○ | ○ | Δ |
| Example I-8 | ○ | ○ | ○ | ◎ | ○ |
| Comparative Example I-1 | ○ | ○ | ○ | ◎ | x |
| Comparative Example I-2 | ○ | ○ | ○ | ○ | x |
| Comparative Example I-3 | ◎ | ○ | ○ | ○ | x |
| Comparative Example I-4 | x | ○ | ○ | ○ | Δ |
| Comparative Example I-5 | ○ | ○ | ○ | x | x |
| Comparative Example I-6 | ○ | ○ | x | ○ | x |
| Comparative Example I-7 | ○ | x | ○ | ○ | ○ |
| Comparative Example I-8 | ○ | ○ | ○ | ○ | x |

EXAMPLES OF SECOND INVENTION

Preparation of Toner Particles C

The above described polyester resin and a cyan pigment (C. I. pigment blue-15-3, made by Toyo Ink Seizo K.K.) were charged into a press kneader to give a resin:pigment weight ratio of 7:3 and were kneaded together. After cooling, the kneaded mixture was ground by a feather mill to obtain a pigment master batch.

Ninety three parts by weight of the polyester resin, 10 parts by weight of the pigment master batch, and 2 parts by weight of a charge control agent (zinc salicylate complex: E-84, made by Orient Kagaku Kogyo K.K.) were mixed by a Henschel mixer. The mixture was then kneaded by a twin-screw extruding-kneader. After having been cooled, the kneaded mixture was subjected to coarse milling by a feather mill, then to pulverization by a jet mill. The resulting particles were classified and, as a result, toner particles B having a volume-mean particle size of 8.0 μm were obtained.

Preparation of Toner Particles D

One hundred parts by weight of the polyester resin, 3 parts by weight of carbon black (Morgal L, produced by Cabot K.K.), and 2 parts by weight of a charge control agent (zinc salicylate complex: E-84, made by Orient Kagaku Kogyo K.K.) were mixed by a Henschel mixer. The mixture was then kneaded by a twin-screw extruding-kneader. After being cooled, the kneaded mixture was subjected to coarse milling by a feather mill, then to pulverization by a jet mill. The resulting particles were classified by an air classifier and, as a result, toner particles D having a volume-mean particle size of 8.0 μm were obtained.

Preparation of Toner

Toner particles obtained as above described were mixed with external additives shown in Table 4, in quantities shown in Table 5, in a Henschel mixer. Mixed particles were sifted through a 200-mesh circular vibrating screen. In this way, toners of several Examples and toners of several Comparative Examples were obtained.

TABLE 4

| | |
|---|---|
| Silica A1 | #130, number-mean particle size 15 nm (made by Nippon Aerosil), hydrophobicized with hexamethyl disilazane; hydrophobicity 60 |
| Silica A2 | #130, number-mean particle size 15 nm (made by Nippon Aerosil), hydrophobicized with dichlorodimethyl silane; hydrophobicity 30 |
| Titania B1 | Anatase-type titania, number-mean particle size 50 nm, hydrophobicized with n-butyl trimethoxy silane; hydrophobicity 55 |
| Titania B2 | Anatase-type titania, number-mean particle size 15 nm, hydrophobicized with n-butyl trimethoxy silane; hydrophobicity 60 |
| Titania B3 | Anatase-type titania, number-mean particle size 50 nm |
| Inorganic fine particle C1 | Strontium titanate, number-mean particle size 350 nm |
| Inorganic fine particle C2 | Alumina-treated titania, number-mean particle size 200 nm, obtained through the process of treating anatase-type titania, number-mean particle size 50 nm, with aqueous dispersion of aluminum chloride, then drying the same, followed by calcination and grinding |
| Inorganic fine particle C3 | Rutile-type titania, number-mean particle size 2000 nm |

TABLE 5

| | | Silica fine particle | | Titania fine particle | | Inorganic fine particle | |
|---|---|---|---|---|---|---|---|
| | Toner particle | Type | Quantity (wt %) | Type | Quantity (wt %) | Type | Quantity (wt %) |
| Example | | | | | | | |
| I-1 | C | A1 | 0.6 | B1 | 0.6 | C1 | 1.5 |
| II-2 | C | A1 | 0.6 | B1 | 0.6 | C1 | 0.8 |
| II-3 | C | A1 | 0.6 | B1 | 0.6 | C1 | 1.8 |
| II-4 | C | A1 | 0.75 | B1 | 0.75 | C1 | 1.5 |

TABLE 5-continued

| | Toner particle | Silica fine particle Type | Silica fine particle Quantity (wt %) | Titania fine particle Type | Titania fine particle Quantity (wt %) | Inorganic fine particle Type | Inorganic fine particle Quantity (wt %) |
|---|---|---|---|---|---|---|---|
| II-5 | C | A1 | 0.6 | B1 | 0.6 | C2 | 0.6 |
| II-6 | C | A1 | 0.6 | B1 | 0.6 | C2 | 1.1 |
| II-7 | C | A1 | 0.6 | B1 | 0.6 | C3 | 1.5 |
| II-8 | D | A1 | 0.6 | B1<br>B2 | 0.3 | C1 | 1.5 |
| Comparative Example | | | | | | | |
| II-1 | C | A1 | 0.4 | B1 | 0.4 | C1 | 1.5 |
| II-2 | C | | Not added | B1 | 0.8 | C1 | 1.5 |
| II-3 | C | A1 | 0.75 | B1 | 0.75 | | Not added |
| II-4 | C | A1 | 0.8 | | Not added | C1 | 1.5 |
| II-5 | D | A1 | 0.4 | B2 | 0.6 | | Not added |
| II-6 | C | A2 | 0.75 | B1 | 0.75 | C1 | 1.5 |
| II-7 | C | A1 | 0.75 | B3 | 0.75 | C1 | 1.5 |

Evaluation of toners specified in Table 5 was made with respect to aggregation noise, environmental stability, toner component adhesion, and thermal storage stability. The results are shown in Table 6.

Evaluation was carried out in the same way as described earlier, except that thermal storage stability was evaluated as describer below.

For thermal storage stability, where 5 g of toner, placed in a glass bottle, was stored for 24 hours at 50° C., if a toner aggregation or cohesion did occur, the toner was rated x; slight aggregation occurred but involved no problem from the practical point of view, in which case the toner was rated Δ; and where no toner cohesion was found, the toner was rated ○.

TABLE 6

| | Aggregation noise | Environmental stability H/H | Environmental stability L/L | Toner component adhesion | Thermal storage stability |
|---|---|---|---|---|---|
| Example II-1 | ○ | ○ | ○ | ◎ | ○ |
| Example II-2 | ○ | ○ | ○ | ○ | ○ |
| Example II-3 | ◎ | ○ | ○ | ◎ | ○ |
| Example II-4 | ◎ | ○ | ○ | ○ | ○ |
| Example II-5 | ○ | ○ | ○ | ○ | ○ |
| Example II-6 | ◎ | ○ | ○ | ◎ | ○ |
| Example II-7 | ○ | ○ | ○ | ◎ | ○ |
| Example II-8 | ○ | ○ | ○ | ◎ | ○ |
| Comparative Example II-1 | x | ○ | ○ | ◎ | Δ |
| Comparative Example II-2 | x | x | ○ | ◎ | Δ |
| Comparative Example II-3 | ○ | ○ | ○ | x | ○ |
| Comparative Example II-4 | x | ○ | x | ○ | Δ |
| Comparative Example II-5 | x | ○ | ○ | Δ | ○ |
| Comparative Example II-6 | Δ | x | ○ | ○ | ○ |
| Comparative Example II-7 | Δ | x | ○ | ○ | ○ |

What is claimed is:

1. A negatively chargeable toner comprising:

toner particles;

first inorganic fine particles having:

a number-mean particle size of from 10 to 30 nm; and a blow-off charge of from −2000 to −500 μC;

second inorganic fine particles having:

a number-mean particle size of from 10 to 90 nm; and a blow-off charge of from −300 to +50 μC; and third inorganic fine particles having:

a number-mean particle size of from 100 to 1000 nm; and a blow-off charge of from −10 to +100 μC.

2. A toner of claim 1, wherein the first inorganic fine particles and the second inorganic fine particles are hydrophobically treated with a hydrophobicizing agent, and respectively have a hydrophobicity of 50 or more.

3. A toner of claim 1, wherein the blow-off charge of the first inorganic fine particles is from −1500 to −800 μC; the blow-off charge of the second inorganic fine particles is from −300 to −10 μC; and the blow-off charge of the third inorganic fine particles is from +10 to +100 μC.

4. A toner of claim 1, wherein the first inorganic fine particles are particles of one or more kinds of materials selected from the group consisting of:

silica, titania, alumina, barium titanate, magnesium titanate, calcium titanate, strontium titanate, chromium oxide, cerium oxide, magnesium oxide, and zirconium oxide.

5. A toner of claim 1, wherein a quantity of the first inorganic fine particles added to the toner particles is 0.1 to 3.0% by weight.

6. A toner of claim 1, wherein the second inorganic fine particles are titania.

7. A toner of claim 1, wherein a quantity of the second inorganic fine particles added to the toner particles is 0.1 to 3.0% by weight.

8. A toner of claim 1, wherein the third inorganic fine particles are strontium titanate.

9. A toner of claim 1, wherein a quantity of the third inorganic fine particles added to the toner particles is 0.3 to 5.0% by weight.

10. A negatively chargeable toner comprising:

toner particles;

first inorganic fine particles having:

a number-mean particle size of from 10 to 30 nm; and
a blow-off charge of from −2000 to −500 μC;

titania particles having:
a number-mean particle size of from 10 to 90 nm; and
a blow-off charge of from −300 to +50 μC; and strontium titanate particles having:
a number-mean particle size of from 100 to 1000 nm; and
a blow-off charge of from −10 to +100 μC.

11. A developing agent comprising:

magnetic carrier particles;

toner particles;

first inorganic fine particles having:
a number-mean particle size of from 10 to 30 nm; and
a blow-off charge of from −2000 to −500 μC;

second inorganic fine particles having:
a number-mean particle size of from 10 to 90 nm; and
a blow-off charge of from −300 to +50 μC; and third inorganic fine particles having:
a number-mean particle size of from 100 to 1000 nm; and
a blow-off charge of from −10 to +100 μC.

12. A developing agent of claim 11, wherein the third inorganic fine particles have a charging characteristic closer to the positive side than the magnetic carrier particles.

13. A developing agent of claim 11, wherein the developing agent is applicable for use in a full color developing apparatus.

14. A toner comprising:

toner particles;

hydrophobic silica fine particles having:
a number-mean particle size of from 10 to 50 nm; and
a hydrophobicity of 50 or more;

hydrophobic titania fine particles having:
a number-mean particle size of from 10 to 90 nm; and
a hydrophobicity of 50 or more;

the combined proportion of the hydrophobic silica fine particles and hydrophobic titania fine particles being from 1 to 3% by weight relative to the toner particles; and inorganic fine particles having:
a number-mean particle size of from 100 to 3000 nm;

the proportion of the inorganic fine particles relative to the toner particles being from 0.3 to 3% by weight.

15. A toner of claim 14, wherein a weight ratio of the silica fine particles to the titania fine particles is from 1:9 to 9:1.

16. A toner of claim 14, wherein the number-mean particle size of the hydrophobic silica fine particles is from 10 to 30 nm; the number-mean particle size of the hydrophobic titania fine particles is from 30 to 90 nm; and the number-mean particle size of the inorganic fine particles is from 100 to 2000 nm.

17. A toner of claim 14, wherein the hydrophobic titania fine particles comprise smaller size particles having a number-mean particle size of from 10 to 30 nm and larger size particles having a number-mean particle size of from 30 to 90 nm.

18. A toner of claim 14, wherein the inorganic fine particles are particles of one or more kinds of materials selected from the group consisting of silica, titania, alumina, barium titanate, magnesium titanate, calcium titanate, strontium titanate, chromium oxide, cerium oxide, magnesium oxide, and zirconium oxide.

19. A toner of 14, wherein the inorganic particles are strontium titanate particles having a number-mean particle size of from 100 to 1000 nm.

20. A toner of claim 14, wherein the toner is applicable for use in a full-color developing apparatus.

* * * * *

UNITED STATES PATENT AND TRADEMARK OFFICE

CERTIFICATE OF CORRECTION

PATENT NO. : 5,776,646
DATED : July 7, 1998
INVENTOR(S) : HAGI et al.

It is certified that error appears in the above-identified patent and that said Letters Patent is hereby corrected as shown below:

Col. 22, line 30: After "of" insert --claim--

Signed and Sealed this

Eighth Day of December, 1998

*Attest:*

*Attesting Officer*

BRUCE LEHMAN

*Commissioner of Patents and Trademarks*